United States Patent [19]

Bubniak et al.

[11] 4,054,621

[45] Oct. 18, 1977

[54] CARBURETOR PNEUMATIC FUEL ATOMIZER AND THROTTLE VALVE

[75] Inventors: William C. Bubniak, Troy; Harry R. Mitchell, Bloomfield Hills, both of Mich.

[73] Assignee: General Motors Corporation, Detroit, Mich.

[21] Appl. No.: 688,692

[22] Filed: May 21, 1976

[51] Int. Cl.[2] ..... F02M 9/02

[52] U.S. Cl. ..... 261/46; 261/62; 261/DIG. 56; 261/DIG. 78

[58] Field of Search ..... 261/62, DIG. 56, 46, 261/DIG. 78

[56] References Cited

U.S. PATENT DOCUMENTS

| | | | |
|---|---|---|---|
| 1,526,318 | 2/1925 | Chandler | 261/DIG. 56 |
| 1,840,570 | 1/1932 | Dilworth | 261/46 |
| 2,084,489 | 6/1937 | Hess | 261/DIG. 56 |
| 2,264,347 | 12/1941 | Udale | 261/37 |
| 2,789,801 | 4/1957 | Durbin | 261/46 |
| 3,069,146 | 12/1962 | MacNeill | 261/44 R |
| 3,747,901 | 7/1973 | Coverston | 261/DIG. 39 |
| 3,949,025 | 4/1976 | Englert et al. | 261/DIG. 58 |
| 3,965,221 | 6/1976 | Roe et al. | 261/DIG. 56 |
| 3,968,189 | 7/1976 | Bier | 261/DIG. 56 |

FOREIGN PATENT DOCUMENTS

| | | | |
|---|---|---|---|
| 416,225 | 7/1925 | Germany | 261/62 |

*Primary Examiner*—Tim R. Miles
*Attorney, Agent, or Firm*—Arthur N. Krein

[57] ABSTRACT

In a carburetor as for a vehicle engine, the carburetor having a throttle body with an induction passage therethrough defined in part by a two-dimensional variable rectangular nozzle having a pair of plane parallel opposite walls and a pair of convergent-divergent contoured walls, one of the contoured walls being mounted to an upstream pivot shaft and actuated by an accelerator pedal operatively connected thereto for pivotal movement relative to the other contoured wall and, a fuel injector means pivotably supported by the pivot shaft and having its fuel discharge means positioned to discharge fuel into the induction passage upstream of the throat of the nozzle, the fuel injector means being operatively linked by a fuel injector positioner linkage to the movable contoured wall so that its angular movement is one-half the angular movement of the movable contoured wall.

1 Claim, 4 Drawing Figures

CARBURETOR PNEUMATIC FUEL ATOMIZER AND THROTTLE VALVE

This invention relates to carburetors for an internal combustion engine and, in particular, to a carburetor pneumatic fuel atomizer and throttle valve device for such a carburetor.

Various types of variable venturi carburetors have been proposed, as improvements over constant diameter carburetors. This is because of the potential ability of such a variable venturi carburetor to maintain a constant air-fuel ratio over large changes in air flow due to the fact that, in such a variable venturi carburetor, the throat of the venturi can be varied as a function of the desired air flow rate. These variable venturi carburetors normally utilize a two-dimensional variable rectangular nozzle therein and are basically of two types, that is, one type, such as disclosed in U.S. Pat. No. 1,526,318 to M. G. Chandler, that employes a butterfly valve or throttle and utilizes the pressure between the butterfly valve and the variable venturi segments to control the position of these segments, and a second type, such as disclosed in U.S. Pat. No. 2,264,347 to S. M. Udale, in which the variable venturi segments are operated directly by the throttle linkage.

However, none of the known types of variable venturi carburetors have been configured so as to take full advantage of the flow characteristics obtainable in a two-dimensional variable rectangular nozzle so as to effect complete atomization of fuel and to form a homogenous mixture of air and fuel for induction into the engine. Specifically, none of the known variable venturi carburetors have been structured whereby to maximize the diffuser flow characteristics of a two-dimensional variable rectangular nozzle to obtain sonic flow through the throat of the nozzle during the entire or substantially entire operating range of the engine.

In addition, many versions of the variable venturi carburetors, having a two-dimensional variable rectangular nozzle therein, that are presently known are inadequate, for practical vehicle application, in terms of smooth, easy, dependable operation. For example, in the type of variable venturi carburetor having incorporated therein movable sliding wall elements to effect variable geometry and sealing, the pressure loading on these wall elements can result in cocking, stick-slip movement, excessive operating forces, and sealing problems.

It is therefore the primary object of this invention to provide a variable venturi carburetor for an internal combustion engine in which the carburetor has incorporated therein a throttle-nozzle mechanism which retains optimum nozzle configuration design parameters for all throttle positions and engine operating conditions.

Another object of this invention is to provide a variable venturi carburetor in which the variable area converging-diverging nozzle thereof is used to effect proper fuel atomization and mixing thereof with air by maintaining induction air flow at sonic velocity through the throat of the carburetor during substantially the entire range (intake manifold depressions) of engine operating conditions.

A further object of this invention is to provide a variable venturi carburetor of the type in which a movable venturi element is used as the throttle whereby the movable venturi-throttle element can be easily and reliably operated by foot pressure applied to a conventional accelerator pedal linkage.

These and other objects of the invention are obtained in a carburetor for a vehicle engine, the carburetor having an air induction passage therethrough defined in part by a convergent-divergent nozzle defined by a pair of opposed fixed planar side walls connected at one side to a fixed convergent-divergent wall and by a movable convergent-divergent wall mounted to an upstream pivot shaft for pivotal movement about the axis of the pivot shaft to provide with the fixed convergent-divergent wall a variable area venturi throat, the movable convergent-divergent wall being connected by an accelerator linkage to the accelerator of the vehicle whereby it also operates as the throttle valve and, a fuel injector is pivotably mounted to the pivot shaft in position to discharge fuel into the air induction stream at the upstream side of the venturi throat, the fuel injector being mechanically coupled to the movable convergent-divergent wall so that it discharges fuel substantially along the centerline of the nozzle.

For a better understanding of the invention, as well as other objects and further features thereof, reference is had to the following detailed description of the invention to be read in connection with the accompanying drawings, wherein.

Figure 1:
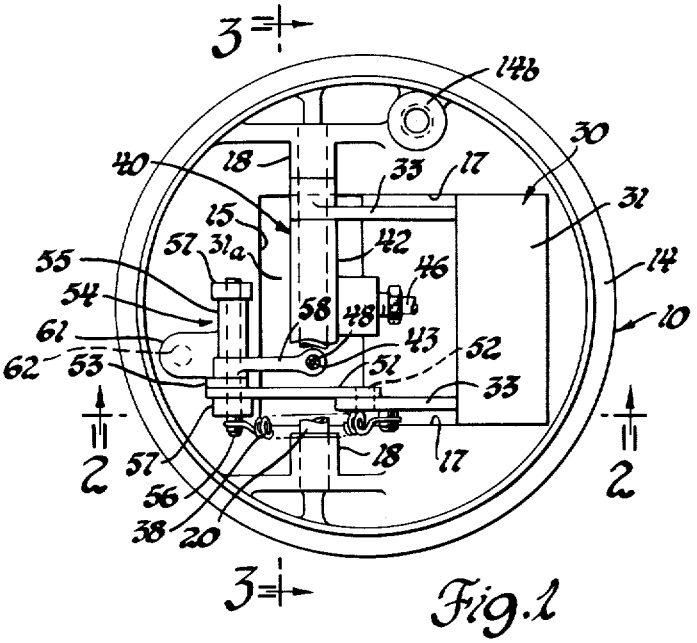
FIG. 1 is a top view of the throttle body assembly of a carburetor constructed in accordance with the subject invention.

Referring now to the drawings, the carburetor pneumatic fuel atomizer and throttle valve, in accordance with the invention and in the construction illustrated, includes a throttle body 10 having a lower flanged base 11 for attachment to the intake port of an intake manifold 12 of an internal combustion engine for a vehicle, not shown, and an upper flanged support 14 for a carburetor fuel bowl assembly, if desired, and an air horn positioned on the throttle body on its upstream side, the air horn assembly and fuel bowl assembly, if desired, not being shown since their constructions are not deemed necessary to an understanding of the subject invention.

The throttle body is provided with a substantially vertically aligned opening therethrough to provide an air inlet port at the upper flanged support 14 end thereof and an air discharge port at the flanged base 11 end thereof, this opening being rectangular in cross section and being defined by integral spaced apart plane front and rear walls 15 and 16, respectively, and by interconnecting parallel planar side walls 17. Rear wall 16 is formed with an internal arcuate or curved upper convergent surface **16*a* and a straight lower divergent portion 16*b***, all for a purpose to be described.

Throttle body 10 is also provided with a pair of parallel spaced apart shaft supports 18 extending upward from the flanged support 14 outboard of the side walls 17. Each of the shaft supports 18 is provided with a suitable aperture therethrough extending at right angle to the side walls 17 whereby the shaft support 18 can receive the opposite ends of a pivot shaft 20 whereby this pivot shaft is positioned to extend across the opening in the throttle body from side to side thereof and parallel to front wall 15.

The pivot shaft 20 is used to support one end of a throttle nozzle, generally designated 30, for pivotal movement about the axis of the pivot shaft 20. As shown, this throttle nozzle 30 includes an intermediate base portion 31 with a wall 32, to be described in detail hereinafter, depending from one side thereof to project into the opening in the throttle body. The throttle nozzle 30 further includes a pair of parallel spaced apart pivot arms 33 extending upward from the intermediate base portion 31, the free end of each of the pivot arms 33 having an aperture therethrough to receive the pivot shaft 20 whereby the throttle nozzle 30 is suitably journaled for pivotal movement about the axis of the pivot shaft 20. Both the base portion 31 and wall 32 have common plane of flat side walls and the width of the base portion 31 and of the wall 32 between these walls is such so that these elements can be slidably received within the opening in the throttle body 10 between the side walls 17 with a minimum clearance therebetween.

Figure 2:
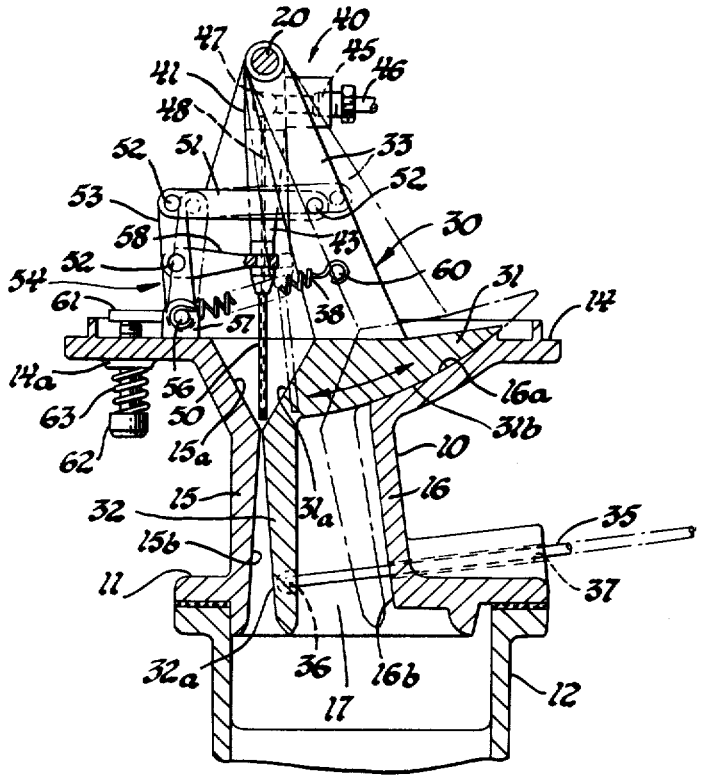
FIG. 2 is a sectional view of the carburetor portion of FIG. 1 taken along line 2—2 of FIG. 1.
Figure 3:
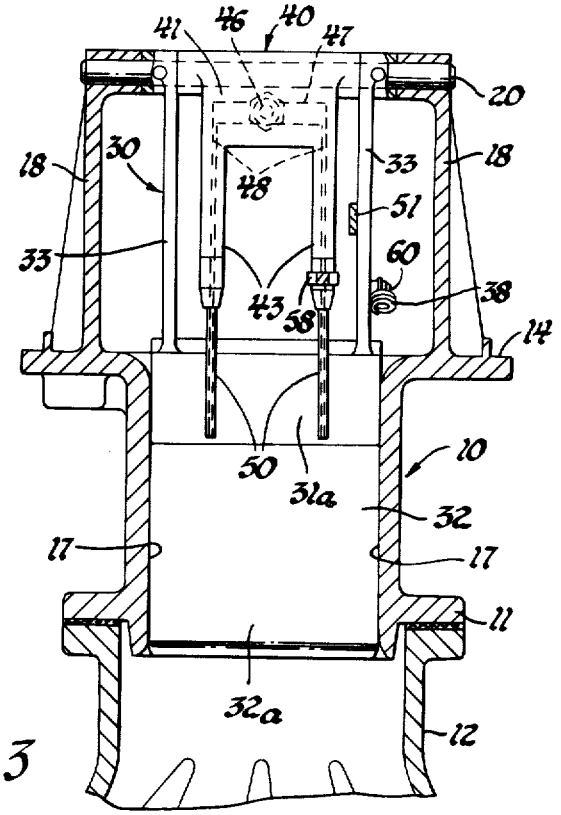
FIG. 3 is a sectional view of the carburetor taken along line 3—3 of FIG. 1; and, FIG. 4 is a sectional view similar to that of FIG. 2 illustrating an alternate embodiment of the subject carburetor pneumatic fuel atomizer and throttle valve.

As best seen in FIG. 2, the front wall 15 is contoured so as to provide one-half of a convergent-divergent nozzle, the other half being formed by the throttle nozzle 30. For this purpose, the interior surface of the front wall 15 of the throttle body 10 includes a convergent portion **15*a* and a divergent portion 15*b*, while an edge of the intermediate base portion 31 of throttle nozzle 30 and the outer surface of depending wall 32 thereof are also provided with internal surfaces relative to the opening in the throttle body 10 that are configured so as to provide a convergent portion 31*a* and a divergent portion 32*a*, respectively, opposite the front wall 15 and movable relative thereto whereby to form the contoured walls of a two-dimensional variable rectangular nozzle, the minimum area section thereof, designated as the throat or nozzle throat, varies as a function of the angular position of the throttle nozzle 30 relative to the interior surface of front wall 15, as pivotably moved between a closed or idle position, the position shown in solid line in FIG. 2, and a wide open throttle position, the position shown in broken lines in FIG. 2**.

Movement of the throttle nozzle 30 between the above positions is affected by means of a throttle link 35 pivotably connected at one end to the depending wall 32 of the throttle nozzle 30 by means of a pivot pin 36, with the opposite end of the throttle link 35 slidably extending through an aperture 37 in the wall 16 of the throttle body 10 for attachment through suitable accelerator linkage, not shown, to the conventional accelerator pedal, not shown, of the vehicle and, by means of of a throttle return spring 38, secured in a manner to be described, that normally biases the throttle nozzle 30 toward the idle position. With this arrangement, the throttle nozzle 30 is operative so as to function as the throttle valve in the carburetor.

Again referring to FIG. 2, it will be seen that the arcuate surface **16*a* of the rear wall 16 of the throttle body 10 and the arcuate bottom surface 31*b* of the intermediate base portion 31 of throttle nozzle 30 are formed as conforming semi-circular segments each of a predetermined radius from the axis of the pivot shaft whereby the surface 31*b* will slide relative to surface 16*a*, with a predetermined clearance therebetween, as the throttle nozzle 30 is pivotally moved between its idle position and its wide open throttle position. In the embodiment shown in FIG. 2, this clearance is such so as to limit the flow of air through the opening in the throttle body 10 on the backside of the throttle nozzle 30, which flow would be termed leakage since, obviously, any air flowing on the backside of the throttle nozzle 30 would not flow through the throat of the nozzle of this assembly. Thus, there are two flat surfaces and one radial arcuate surface on the throttle lever, which are not rubbing seals, for sealing the throttle nozzle 30 in the bore of the throttle body 10**. Because small leakage is acceptable, some reasonable predetermined clearance between the sealing surfaces can exist.

Figure 4:
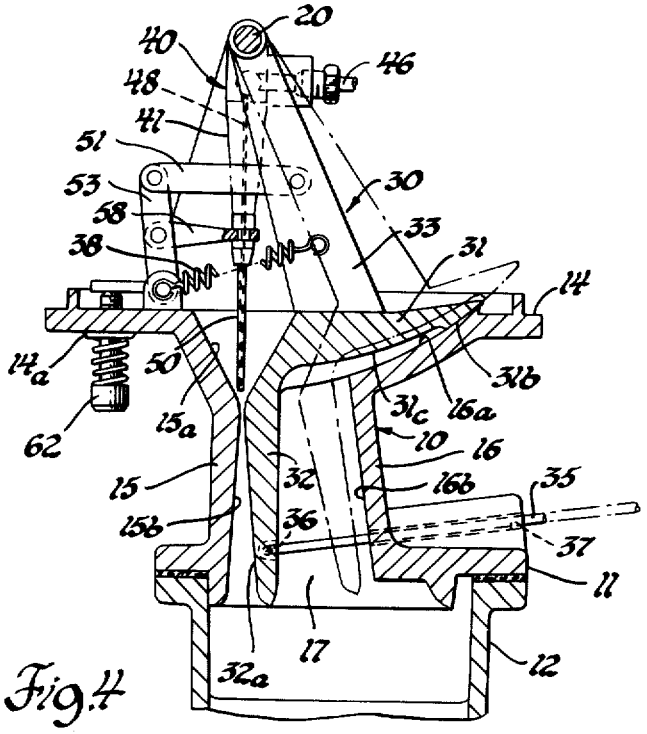

However, in the alternate embodiment illustrated in FIG. 4, means are provided, as desired, whereby to limit leakage of air on the backside of the throttle nozzle 30 from the idle position to a part throttle position while providing for a secondary throttle air inlet from the part throttle position to the wide open throttle position of the throttle nozzle 30, whereby secondary air can flow through an orifice arrangement bypassing the nozzle. Thus, as shown in FIG. 4, a leading edge portion of the bottom surface **31*b* of the throttle nozzle 30 cooperates with the arcuate surface 16*a* of the throttle body 10 to restrict the bypass flow of air on the backside of the throttle nozzle in the manner described above, but, in addition, the remaining portion of this bottom surface 31*b* is provided with a suitable groove 31*c* extending from a predetermined distance from the leading edge of this bottom surface to the trailing edge next adjacent the depending wall 32 so as to provide a secondary air flow passage. This groove 31*c* is of a predetermined cross sectional area so as to form with the arcuate surface 16*a*, a flow orifice, scheduled, as desired, for the desired flow of secondary air, exhaust or crankcase ventilation gases, to the engine. It will be apparent from the structure illustrated in FIG. 4 that the desired secondary air flow does not occur until the throttle nozzle 30** has been moved from its idle position to a predetermined part throttle position, after which secondary air flow will occur at all positions of the throttle nozzle between this part throttle position and the wide open throttle position.

In order to provide the engine with an induction charge of mixed fuel and air, the fuel, in accordance with the invention, is delivered into the induction passage of the carburetor upstream of the throat of the nozzle. Thus in the construction of the carburetor illustrated, liquid fuel is introduced into the induction passage of the carburetor by means of a fuel injector, generally designated 40, positioned, in a manner to be described, so as to discharge liquid fuel into the air stream upstream of the throat of the nozzle in the throttle body 10.

In the construction illustrated, the fuel injector 40 includes an injector body having a substantially inverted U-shaped configuration formed by a base 41 having a pair of spaced apart parallel legs 43 depending therefrom intermediate its ends. The base 41 is provided with a bore extending longitudinally therethrough whereby to slidably receive the pivot shaft 20 so that the injector 40 is pivotally supported by its base on the pivot shaft 20 for pivotal movement relative to the throttle nozzle 30. As shown, the base 41 of the fuel injector 40 is positioned between the pivot arms 33 of the throttle nozzle 30, with the legs 43 of the injector body positioned to extend toward the induction passage inlet in the throttle body 10. The base 41 of the injector is provided with a central inlet passage 45 that is connectable by a fuel line conduit 46 to a fuel source, not shown, used to supply the fuel injector 40 and therefore the engine with metered quantities of pressurized fuel in a known manner. As shown in FIG. 1, the upper flanged support 14 is provided with a threaded apertured bulkhead boss 14*b* to receive the fuel line conduit 46 and an extension thereof, not shown, whereby this fuel line conduit is routed to the exterior of the carburetor. The base 41 is also provided with a longitudinal extending fuel passage 47 therein that is in communication intermediate its ends with the inlet passage 45 and that at each of its ends is in communication with a fuel discharge passage 48 extending through a leg 43. In addition, each leg 43, at its free end, has a fuel injector tube 50 formed integral therewith or, as shown, secured thereto in a suitable manner, with the tube 50 in communication with the discharge passage 48 in that leg. The length of each injector tube 50 is such that its free end will extend downward into the induction passage inlet in the throttle body to terminate in the vicinity of the throat of the nozzle within the throttle body 10. The diameter of the tubes 50 extending into the inlet of the induction passage in the throttle body is such so as not to unduly restrict or alter air flow through the passage.

In order to inject fuel into the middle of the stream of air entering the induction passage in the throttle body 10, the fuel injector is pivotably moved in conjunction with the pivotal movement of the throttle nozzle 30. To effect pivotal movement of the fuel injector 40 upon pivotal movement of the throttle nozzle 30, the latter has one end of an actuator link 51 pivotally secured by a pin 52 to one of its arms 33, intermediate the ends of this leg. The opposite end of the actuator link 51 is pivotally connected to the free end of the lever 53 portion of a pivot lever, generally designated 54, by a pin 52 positioned next adjacent the free end of lever 53. The pivot lever 54, as best seen in FIG. 1, includes the lever 53 which extends radially outward from a tubular base 55 pivotally encircling a stub shaft 56 that is supported at its opposite ends by a pair of spaced apart brackets 57 extending upright from the upper flanged support 14 of the throttle body 10, each of the brackets 57 being suitably apertured so as to receive the stub shaft 56 therein. Intermediate its ends, the lever 53 is pivotally secured by a pin 52 to one end of an injector link 58, the opposite end of the injector link being secured in a suitable manner to the fuel injector 40 as by being secured to a leg 43 thereof, for movement therewith.

By proper location of the above described linkage, the fuel injector 40 will be pivoted about the axis of the pivot shaft 20 upon pivotal movement of the throttle nozzle 30, but the angular movement of the fuel injector 40 will always be one-half the angle through which the throttle nozzle 30 is moved so that the fuel is delivered into the middle of the air stream entering the nozzle at all nozzle openings. Although the central fuel induction position accuracy is not extremely critical, this central induction is essential in order to minimize fuel sprayed and deposited on the nozzle wall whereby to maintain excellent atomization of fuel during all operating conditions of the engine. As shown, one end of the stub shaft 56 projects outward from a bracket 57 whereby to receive one end of the throttle return spring 38, the other end of the throttle return spring being secured by a fixed pin 60 to an arm 33 of the throttle nozzle 30 whereby the throttle nozzle is always biased in a pivotal direction towards its idle position.

In addition to the above described mechanism for effecting movement of the throttle nozzle 30, the back surfaces of those portions of the base portion 31 and of the wall 32 of the throttle nozzle projecting into the opening in the throttle body 10 form, with the side walls 17 and rear wall 16 thereof, a depression feedback chamber that is open to the flow of induction air downstream of the nozzle. With this arrangement, the throttle nozzle 30 is partially pressure balanced relative to the pressure profile existing along the nozzle flow path acting on the nozzle surface of wall 32 opposite to the rear surface thereof whereby to reduce the applied force at the above identified throttle controls. It should also be realized that with the provision of this depression feedback chamber, any unbalanced pressure loads on the throttle nozzle 30, that is a greater pressure in the pressure feedback chamber than in the nozzle, would tend to pivotally move the throttle nozzle in a throttle closing direction.

To control the idle position of the throttle nozzle 30, and thereby its angular stop position relative to the wall 15, whereby a sufficient air flow passage is formed at the throat to permit sufficient induction air to pass through the throat of the nozzle so as to maintain engine idle operation, the tubular base 55 of the pivot lever 54 is provided with a radially outward extending stop flange 61 at right angle to lever 53 that is positioned to overlay an idle stop position screw 62 adjustably threaded through a suitable threaded apertured boss 14*a* provided for this purpose in the upper flanged support 14. A spring 63 encircles the shank of this screw 62 between its head and the boss 14*a* of upper flanged support 14, whereby to maintain the adjusted position of this screw.

In operation, the convergent section of the nozzle forming the induction passage in the throttle body 10 provides a gradual transition from very low subsonic entrance velocity of air entering the induction passage at a pressure $P_o$ in the throttle body of the carburetor to sonic velocity at the throat throughout at least most of the range of operation of the engine (intake manifold depression), and then to supersonic velocity in the divergent section of the nozzle. However, this supersonic velocity of the air flowing through the carburetor progresses to a region in the divergence where a rapid transition occurs (shock zone) to subsonic velocity before the air is discharged from the nozzle into the large volume induction passage chamber in the interior of the engine intake manifold 12.

In regard to the fluid mechanics of the subject carburetor during its operation, liquid fuel as from one or more injector tubes 50 of the fuel injector 40 is introduced into the stream of intake air and into the nozzle converging section substantially centrally thereof whereby to effect uniform distribution of the fuel as it flows through the nozzle throat and into the diverging sections of the nozzle. The velocity of the air and fuel droplet mixture is increased substantially as it passes through the nozzle throat. However, the velocity of air accelerates to the sonic velocity extremely fast and much faster than the fuel droplets which result in efficient pneumatic atomization of the fuel into minimum and more uniform droplet sizes. The air and fuel mixture downstream of the nozzle throat continues to be accelerated to supersonic velocity in the diverging section of the nozzle and then this mixture is decelerated to subsonic velocity to produce a shock zone, in the manner previously described. It is believed that the then small fuel droplets are still further subdivided in the shock zone, along with added mixing of the air and fuel, because extreme relative differences in velocity between the air and fuel droplets are again established. This intense secondary mixing of the air and fuel in the shock zone results in a most significant advantage for the subject carburetor structure since the engine induction system is thus furnished with a superior homogenous air-fuel induction mixture.

So as to obtain maximum utilization of the variable area converging-diverging nozzle in the throttle body 10 as a fuel atomizer, it is necessary to maintain the incoming air at sonic velocity at the throat of the nozzle over as large a range of engine operating conditions (intake manifold depression) as possible. Thus, for efficient operation, it is desirable to have a throttle-nozzle mechanism, in accordance with the invention, which retains optimum nozzle configuration design parameters for all throttle positions and engine operating conditions. Specifically, the configuration of the converging-diverging nozzle arrangement to effect most efficient operation should be such that the exit area, next adjacent to the trailing edge of the diverging surfaces to the throat area ratio, be equal to or larger than 4.0, while maintaining an included angle of the diverging section of the nozzle between 6° and 12°. In a variable area nozzle carburetor application, such as that disclosed, one or both of these parameters change as the throttle position is varied. Therefore, depending on the design implementation of the variable area mechanism, these parameters can be maintained favorable over a relatively large range of engine operation conditions. Accordingly, in the subject variable area nozzle arrangement, the pivot shaft 20 is positioned externally and upstream of the nozzle, as best seen in FIG. 2, at a suitable distance from the nozzle throat whereby the nozzle design parameters can be maintained over a relatively large range of throttle openings. Thus, with the variable area nozzle arrangement shown, sonic and supersonic flow conditions are extended over a relatively large range of engine operating conditions, including the most critical range of engine operation in terms of the air-fuel mixture supplied thereto.

Thus, sonic velocity of the air flow through the nozzle throat can be achieved over most of the engine operating range by favorable design of the variable geometry converging-diverging nozzle for the carburetor. Experimental flow tests of both fixed and variable geometry nozzles has shown that sonic velocity can be maintained when the downstream depression is below approximately 0.8 of the upstream pressure $P_o$.

Therefore, with conventional engine operation, it has been found that the critical pressure level for maintaining sonic velocity in the throat of the nozzle is exceeded only when approaching maximum demand for engine power. Consequently, excellent atomization is attained by the subject carburetor pneumatic fuel atomizer and throttle valve structure of the invention during most operating conditions of an engine. When velocities lower than sonic are experienced, it has been found that the quality of atomization does not deteriorate rapidly with decreasing velocities. Accordingly, although the superior atomization with the subject type of atomizer does degrade somewhat when subsonic throat velocities are encountered, experimental tests have shown that atomization is still acceptable at flow rates comparable to maximum engine power with such atomization still being better than that obtainable with prior art types of variable venturi carburetors.

It should be realized that the carburetor pneumatic fuel atomizer and throttle valve of the subject invention, as disclosed, is essentially a subsystem of a total fuel-air metering system. It will thus be apparent that the subject carburetor pneumatic fuel atomizer and throttle valve structure can readily be adapted for use with a conventional carburetion system using a float bowl either pressurized or vented or that it could be incorporated into an electrically controlled pressurized carburetion system. It will also be apparent from the above that although one type of fuel injector device, such as the fuel injector 40, has been illustrated, other types of fuel delivery mechanisms, such as electro-magnetic fuel nozzles, could be incorporated into the subject carburetor pneumatic fuel atomizer and throttle valve structure without departing from the scope of Applicants' invention.

It is also to be realized that, although only one form of fuel injector positioner linkage has been illustrated to effect the desired coordinated movement of the fuel injector 40 relative to but with movement of the throttle nozzle 30, other well-known mechanical expedients can be utilized to effect the above described coordinated movement between the fuel injector and the throttle nozzle 30 without departing from the scope of the subject invention.

What is claimed:

1. An engine carburetor including a throttle body means having a first end wall and an opposite second end wall, said throttle body means having an enlarged opening, rectangular in cross section, extending from said first end wall therethrough to define an induction passage having an air inlet end at said first end wall and an air-fuel induction outlet end at said second end wall, said passage being defined by an interior first wall means, an interior second wall means spaced from said first wall means, and by interconnecting side walls, said first wall means defining a convergent-divergent venturi nozzle portion for said passage, said throttle body means including a pivot support means having a pivot support positioned upstream of said first end wall, a movable throttle means including arm means pivotably connected at one end to said pivot support for pivotable movement about a pivot axis and throttle wall means fixed to its opposite end, one side of said throttle wall means defining a convergent-divergent venturi throttle nozzle portion extending into said passage for movement between said first wall means and said second wall means whereby to define with said first wall means a variable area venturi nozzle, said second wall means including a divergent wall portion opposite the divergent portion of said convergent-divergent nozzle portion defined by said first wall means and an arcuate wall portion extending away from said divergent wall portion to interconnect with said first end wall, the opposite side of said throttle wall means including a rear surface portion joining an arcuate surface portion, said arcuate surface portion being positioned to slide relative to said arcuate wall portion with a predetermined clearance therebetween and a groove means in said arcuate surface portion extending from a predetermined distance from the free end thereof to substantially said rear surface portion whereby to provide with said arcuate wall portion a controlled secondary air flow passage bypassing said variable venturi nozzle, an accelerator linkage means operatively connected to said movable throttle means to effect pivotable movement of said movable throttle means, a fuel injector nozzle means having a fuel discharge port means at one end and having its opposite end pivotably supported by said pivot support for pivotal movement about said pivot axis relative to the throttle means, said fuel injector nozzle means being connectable to a source of liquid fuel, said fuel discharge port means being positioned to discharge fuel to the upstream side of said variable area venturi nozzle, and fuel injector positioner linkage means operatively connected to said movable throttle means and to said fuel injector nozzle means whereby said fuel discharge port means is positioned substantially midway between said first wall means and said venturi throttle nozzle portion during movement of said venturi throttle nozzle portion relative to said first wall means.

* * * * *